United States Patent [19]

Kopse et al.

[11] 4,170,974

[45] Oct. 16, 1979

[54] HIGH PRESSURE FUEL INJECTION SYSTEM

[75] Inventors: Odon Kopše, Stuttgart; Heinz Kuschmierz, Gerlingen, both of Fed. Rep. of Germany

[73] Assignee: Robert Bosch GmbH, Stuttgart, Fed. Rep. of Germany

[21] Appl. No.: 751,248

[22] Filed: Dec. 16, 1976

[30] Foreign Application Priority Data

Dec. 24, 1975 [DE] Fed. Rep. of Germany ..... 2558789

[51] Int. Cl.[2] ..... F02M 39/02; F02B 15/00

[52] U.S. Cl. ..... 123/139 AT; 123/139 AK; 123/139 DP; 123/32 JV

[58] Field of Search ..... 123/139 AK, 139 AT, 123/139 DP, 32 JV; 239/88

[56] References Cited

U.S. PATENT DOCUMENTS

| | | | |
|---|---|---|---|
| 2,313,264 | 3/1943 | Reggio | 123/139 AK |
| 2,420,550 | 5/1947 | Miller | 123/139 AT |
| 2,625,436 | 1/1953 | Berlyn | 123/139 AT |
| 2,984,230 | 5/1961 | Cummins | 123/139 AT |
| 3,796,206 | 3/1974 | Links | 123/139 AK |
| 3,908,621 | 9/1975 | Hussey | 123/139 AT |
| 3,943,901 | 3/1976 | Takahashi et al. | 123/139 AT |
| 3,952,711 | 4/1976 | Kimberley et al. | 123/139 AT |
| 4,036,192 | 7/1977 | Nakayama | 123/139 AT |

FOREIGN PATENT DOCUMENTS

| | | | |
|---|---|---|---|
| 2311189 | 10/1976 | France | 123/139 AT |
| 352298 | 7/1931 | United Kingdom | 123/139 AK |

*Primary Examiner*—Charles J. Myhre
*Assistant Examiner*—P. S. Lall
*Attorney, Agent, or Firm*—Edwin E. Greigg

[57] ABSTRACT

A high pressure fuel injection system includes a pump-type fuel injection nozzle assembly provided with a sliding control valve which admits pressurized fuel or opens a return channel. A pressure chamber situated near the end of the needle valve of the nozzle remote from its seat is connected via a bypass channel with a region downstream of the sliding valve for the purpose of exerting a hydraulic closing force on the needle valve. The pressure in the bypass channel is controlled by the motions of the sliding valve. Alternatively, the additional hydraulic pressure may be exerted on the needle by an intermediate piston.

14 Claims, 3 Drawing Figures

HIGH PRESSURE FUEL INJECTION SYSTEM

BACKGROUND OF THE INVENTION

The invention relates to a high pressure fuel injection system for diesel engines including a hydraulically driven piston pump and an injection nozzle. The piston pump and the injection nozzle may be combined into a single assembly in which the pump piston is driven by a servo piston of large diameter and wherein a switching valve alternately admits fluid pressure to the servo piston and connects the servo piston with a return line at low pressure. The injection nozzle includes a valve needle which is loaded in the closure direction by a spring and in addition may be loaded by servo pressure admitted through a bypass channel.

In a known fuel injection system of this type, embodied as a pump/nozzle assembly (see, for example, U.S. Pat. No. 2,916,028), the servo pressure acting on the valve needle is a type of hydraulic spring and thus affects both the opening as well as the closing pressure of the injection nozzle. In another known injection system of the type described above, (see, for example, U.S. Pat. No. 3,908,621) the closing spring of the injection nozzle is additionally affected by servo pressure whose magnitude is changeable in order to change the injection pressure of the system and thus also changes the strength of the hydraulic spring acting on the valve needle in a manner which is proportional to the servo pressure. Both of these injection systems share the disadvantage that the servo pressure acting as a supplementary hydraulic spring affects both the opening as well as the closing pressure acting on the injection nozzle, by the same amount.

Modern diesel engines subjected to heavy loads require extremely short injection times. In addition, the injection process must be capable of abrupt termination, preferably within one degree of crankshaft angle, because a delayed termination of injection and the resulting postinjection dribbling result in poor combustion and an increase in the emission of hydrocarbon and CO components. The most favorable combustion process is achieved if the injection begins at a relatively low opening pressure resulting in a short injection jet and if the pressure is increased toward its maximum value near the end of the injection with a correspondingly longest injection jet and is then abruptly interrupted. As a practical matter, a very abrupt needle valve closure is extremely difficult to realize due to the hydraulic and mechanical conditions in a fuel injection system.

OBJECT AND SUMMARY OF THE INVENTION

It is thus a principal object of the invention to provide a fuel injection system including a pump piston-nozzle assembly in which the needle closure at the injection nozzle takes place very rapidly. It is a second object of the invention to provide a pump/nozzle assembly in which the injection pressure increases during injection.

These and other objects are attained according to the invention by providing that a pressure chamber in communication with the valve needle and capable of exerting pressure thereon is connected through a bypass channel with a control pressure chamber to which primary servo pressure can be admitted. By this means, the injection nozzle experiences a hydraulic closing pressure increase only toward the end of the injection stroke. Furthermore, this system corresponds in the desired manner with the normal progress of pressure delivered by a hydraulically driven piston pump, which is initially proportional to the nozzle opening pressure and achieves its maximum value near the end of the stroke. Thus, the nozzle opening pressure and the nozzle cross section may be freely chosen, quite independently of the maximum attainable nozzle closing force. Also, the pre-tension of the closing spring of the valve needle can be reduced because of the additional hydraulic force available even at the onset of injection. A particularly simplified construction of the system is given by letting the needle spring chamber act as the additional pressure chamber.

The invention will be better understood as well as further objects and advantages thereof become more apparent from the ensuing detailed description of three preferred embodiments taken in conjunction with the drawing.

DESCRIPTION OF THE PREFERRED EMBODIMENTS

Figure 1:
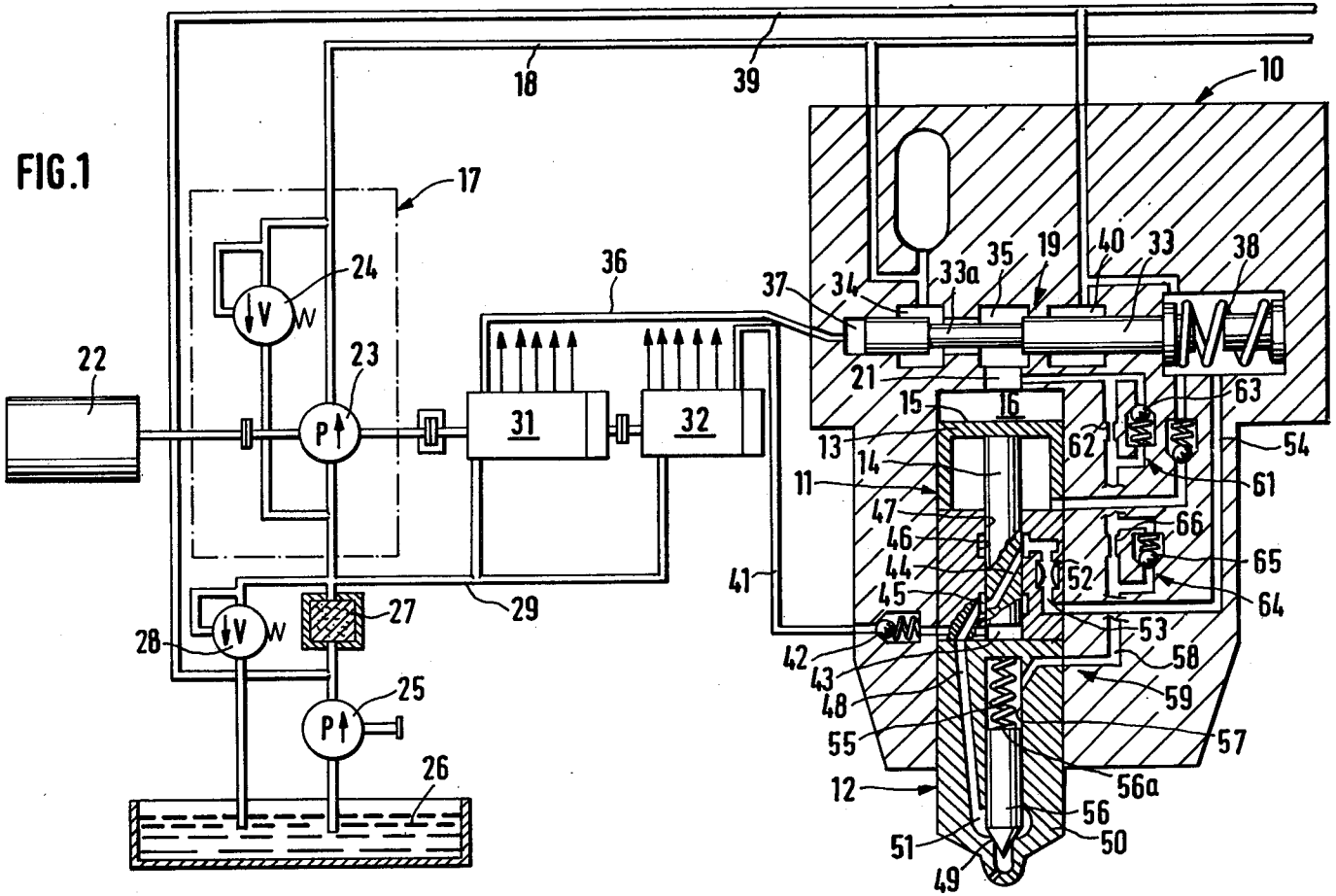
FIG. 1 is a schematic and partially sectional illustration of a fuel injection system according to the invention including a detail of the pump/nozzle assembly of the invention.

Turning now to FIG. 1, there will be seen a high pressure fuel injection system including a pump/nozzle assembly 10 which consists substantially of a hydraulically driven piston pump 11 and an injection nozzle 12. In known manner, the pump 11 is embodied as a servo pump, i.e., it includes a servo piston 13 and a pump piston 14, together constituting a differential piston. The face 15 of the servo piston 13 movably defines one wall of a servo pressure chamber 16 to which is admitted fuel under servo pressure $P_S$ coming from a pressure source 17 via a supply line 18, a switching valve 19 and a control chamber 21.

The pressure source 17 generating the servo pressure consists substantially of an adjustable high pressure pump 23 driven by a engine 22 and including a pressure-limiting or control valve 24. The high pressure pump 23 is fed by a low pressure pump 25 which aspirates fuel from a tank 26 through a filter 27 and delivers it to the high pressure pump 23. The supply pressure of the low pressure pump is limited by a further pressure limiting valve 28. A branch line 29 supplies fuel to pressure distributors 31 and 32.

The switching valve 19 is embodied as a sliding spool valve and the control slide 33 moves in the top of the pump nozzle assembly 10 where it is illustrated in its normal position, i.e., when the nozzle is closed. In that position, the slide 33 connects the servo pressure chamber 16 with the servo pressure supply line 18 by permitting communication between a first annular chamber 34 and a second annular chamber 35 via a region of reduced diameter 33*a*. The control slide 33 may be axially moved, in particular into its second position, not shown, by a pressure control pulse produced by the pressure unit 31 in synchronism with the speed of the engine 22. This control pressure is fed via a line 36 to a control pressure chamber 37. In the second position of the control plunger 33, communication is established between the servo pressure chamber 16 through the control chamber 21, the annular chamber 35, the reduced region 33*a* and the third annular chamber 40 of the valve 19. The annular chamber 40 is connected to a return line 39 which terminates in the junction between the supply pumps 25 and 23 and thus experiences the pressure of the low pressure pump 25. It will be understood that the return line 39 could also be terminated in the tank 26 where atmospheric pressure prevails.

The pressure unit 31 may be a known rotary distributor or a piston pump or a solenoid controlled mechanism which permits movement of the control plunger 33 into its illustrated position by relieving the pressure in the chamber 37, thereby initiating the injection process as servo fuel is fed into the servo pressure chamber 16. The second pressure unit 32 is a fuel metering system connected through a line 41 and the pressure valve 42 with a pump work chamber 43 defined by the pump piston 14. The fuel metering system could also be any suitable injection pump driven as illustrated by the engine 22. Both pressure units 31 and 32 will not be further described because they are not directly involved in the subject of the present invention.

In the illustrated position of the pump piston 14, the connection from the work chamber 43 to the injection nozzle 12 is interrupted. However, a channel 44 within the pump piston 14 permits communication between annular chambers 45 and 46 defined within the wall of the cylinder 47. The annular chamber 45 communicates through a pressure channel 48 with a pressure chamber 51 adjacent to the valve seat 49 within the nozzle housing 50. The annular chamber 46 is coupled via a relief bore 53 including a throttle 52 to a line 54 leading back to the return line 39. Thus, in the illustrated position of the pump piston 14, the pressure chamber 51 in the nozzle 12 is pressure-relieved with respect to the return line 39.

In known manner, the valve seat 49 of the injection nozzle 12 is obturated between injection events by a valve needle 56 which is urged to move toward the valve seat by a closing spring 55.

A spring chamber 57 which houses the closing spring 55 is connected to the control pressure chamber 21 by a bypass channel 58. Accordingly, the pressure prevailing in the servo pressure chamber 16 is also exerted in the spring chamber 57 and thus acts to increase the needle closing force in a region 59. Accordingly, a force is exerted on the valve needle 56 which is proportional to the pressure prevailing in the servo pressure chamber 16. This pressure may also be applied in known manner via a pressure transmitting piston sealingly guided within the housing 50 of the nozzle 12 and not shown in FIG. 1, thereby performing a change in the pressure ratio.

At the end of the injection process, the maximum servo pressure $P_S$ is exerted on the valve needle 56, thereby pressing it on its valve seat 49. Only in the second position (not shown) of the control plunger 33 and at the beginning of the filling stroke of the two pistons 13 and 14, does the pressure in the spring chamber 57 decrease to that prevailing in the return line 39 so that the valve needle 56 is now affected by the force of the spring 55 and the reduced pressure in the spring chamber 57. When the control plunger 33 is returned to its illustrated position, the servo pressure $P_S$ prevailing in the line 18 is admitted by the valve 19 to the servo pressure chamber 16 and the pumping stroke of the pump piston 14 begins. The pressure actually prevailing in the servo pressure chamber 16 at the beginning of the pumping or injection stroke is determined by the opening pressure and subsequent injection pressure behavior at the injection nozzle 12. This pressure achieves its maximum value only at the end of the injection stroke and is transmitted via the bypass channel 58 into the spring chamber 57, thereby urging the valve needle 56 onto its seat 49. This very rapid closure of the valve needle 56 is further enhanced by the fact that, just prior to the end of the pumping stroke or at the same time as the deceleration of the pump piston 14, the annular chamber 45 is connected to the return line 39 via the channel 44 within the pump piston 14 and the relief bore 53 so that the pressure chamber 51 is relieved. In order to function as described, the bypass channel 58 must be connected to a control chamber in the vicinity of the switching valve 19 which, in the described embodiment, is the control chamber 21, acting as a control chamber. However, the bypass channel could also be connected to the annular chamber 35 or the upper region of the servo pressure chamber 16.

The bypass channel 58 includes a pressure control mechanism 61 consisting of a throttling or control valve 62 and a parallel check valve 63 opening in the direction of the spring chamber. The throttling or pressure control valve 62 may be adjusted arbitrarily or in dependence on engine parameters such as rpm or load, thereby permitting adjustment of the remanent fuel pressure in the spring chamber 57. In other words, the nozzle opening pressure may be changed in dependence on engine variables. The valve 62 may also be adjusted to keep the remanent pressure in the spring chamber 57 at a level higher than that prevailing in the return line 39 so that it acts at the onset of injection as a hydraulic spring in parallel with the closing spring 55, where the force of this additional hydraulic spring is then increased by the increasing pressure in the servo pressure chamber 16 during the course of the injection. If the pressure in the spring chamber 57 serving to increase the needle closing pressure is intended to be controlled additionally in dependence on the already mentioned engine variables, or if it is to be adjusted arbitrarily, a second pressure control system 64 may be inserted in the bypass channel 58. This second pressure control system 64 would include elements similar to that of the mechanism 61, namely a check valve opening in the direction from the spring chamber 57 to the control chamber 21 and a throttle or control valve 66 which controls the flow to the spring chamber 57. Depending on the desired injection program, both pressure control mechanisms 61 and 64, or one of them, or even neither, may be inserted into the bypass channel 58. If it is desired only to control the pressure of the fuel flowing to the chamber 57 through the bypass channel 58, a single throttle valve 62 would suffice.

Figure 2:
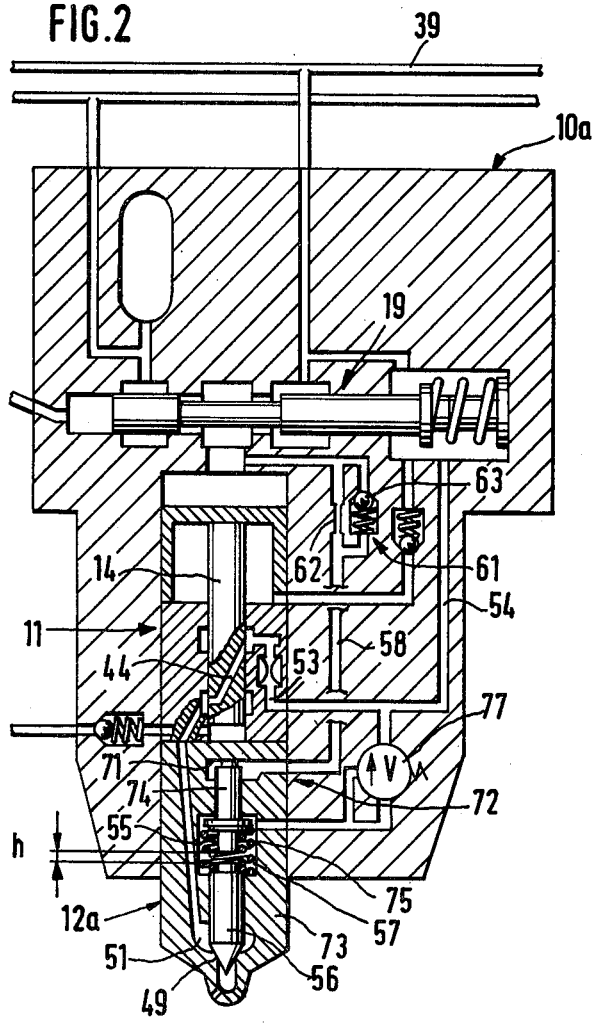
FIG. 2 is an illustration of a second embodiment of the pump/nozzle assembly of the invention.

The second exemplary embodiment of the invention is illustrated in FIG. 2 and differs from that of FIG. 1 only in the different embodiment of the pump/nozzle assembly 10*a*. Parts identical to those previously described retain the same reference numerals in FIG. 2. In particular, the switching valve 19 and the pump piston 11 are identical with those in the pump/nozzle assembly 10 of FIG. 1. The injection nozzle portion 12*a* differs from the injection nozzle 12 in FIG. 1 substantially in that an intermediate piston 74 glides sealingly in the nozzle housing 73 and one of its faces extends into a pressure chamber 71 while the other face extends into the spring chamber 57. Prior to the onset of injection, i.e., when the valve needle is seated, the end of the valve needle adjacent the intermediate piston is separated from its face by a predetermined distance h. The intermediate piston 74 is pressed into a position in which there is a clearance h to the valve needle by a return spring 75 as well as by the force of the closing spring 55 of the injection nozzle 12*a*. Depending on the magnitudes of the pressures and the diameters of the pistons, the closing spring 55 may alone serve as the return spring for the intermediate piston 74. Furthermore, if no separate stop is provided to limit the opening stroke of the needle, the distance h is equal to the stroke of the injection needle and the intermediate piston 74 also serves as a stop to limit the stroke.

In the exemplary embodiment of FIG. 2, the pressure chamber 51 adjacent to the valve seat 59 is pressure-relieved with respect to the return line 39 via the channel 44, the relief bore 53 and the line 54.

Figure 3:
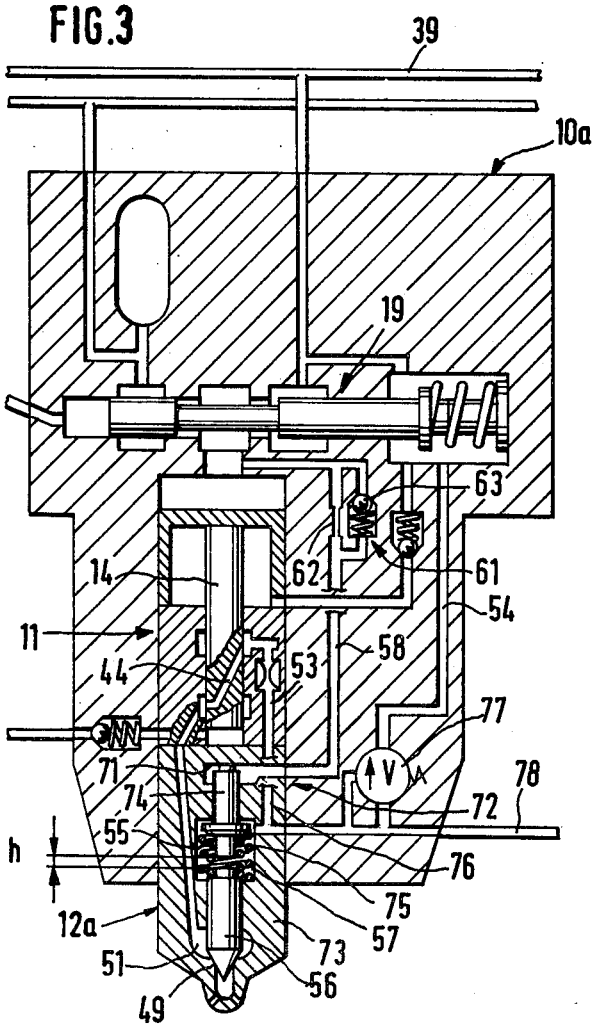
FIG. 3 is an illustration of the third exemplary embodiment of the pump/nozzle assembly of the invention.

In a third exemplary embodiment illustrated in FIG. 3, the needle closing pressure may be increased by providing that the relief bore 53 is not connected directly to the line 54 but instead is connected with the spring chamber 57 through a channel 76. In that case, the pressure in the spring chamber 57 is limited by a pressure control valve 77 or is controlled in dependence on engine variables such as rpm and/or load. The spring chamber 57 is connected to the line 54 leading to the return line 39 via the pressure control valve 77 so that the direct connection between the relief bore 53 and the line 54 is interrupted in this case. In applications in multi-cylinder engines, a single pressure control valve 77 is sufficient for all of the pump/nozzle assemblies which are connected to a line 78. If the closing spring 55 is not supported within the valve housing 73, i.e., in the spring chamber 57, and if the intermediate piston 74 is not affected by the force of the return spring 75, then the servo pressure prevailing in the control chamber 21 acts as a hydraulic spring at the onset of injection via the intermediate piston 74 and exerts its force on the valve needle 56 in a manner which corresponds to the behavior of the injection pressure during each injection process. Thus the closing spring 55 may be dimensioned to be correspondingly weaker and the maximum peak pressure acts on the valve needle 66 only at the end of the injection process as desired, thus leading to an abrupt needle closure.

Even though the relief bore 53 in the second exemplary embodiment of FIG. 2 is not connected through a channel 76 with the spring chamber 57 as is done in the third embodiment in FIG. 3, the pressure of any leakage fuel in the spring chamber 57 may nevertheless be controlled by the pressure control valve 77.

In all of the embodiments according to FIGS. 1 to 3, the servo pressure obtained behind the switching valve 19 causes the increase of the closing pressure in the nozzle to be proportional to the injection pressure, thus leading to the desired abrupt and rapid needle closure and the accompanying abrupt termination of injection.

The foregoing relates to preferred exemplary embodiments of the invention, it being understood that other embodiments and variants are possible within the spirit and scope of the invention, the latter being defined by the appended claims.

What is claimed is:

1. In a high pressure fuel injection system which includes a hydraulically driven piston-type pump and nozzle assembly for each cylinder, each assembly further including a servo pressure chamber, a servo piston in said pressure chamber, said servo piston having a diameter larger than the diameter of the pump piston of said piston-type pump for actuating said pump piston, and a switching valve for selectively connecting the servo pressure chamber with a source of high pressure fluid and with a return line, said nozzle further including a valve-closing needle and a valve-closing spring contained in a spring chamber, the improvement comprising:

a pressure chamber situated near the end of said valve needle remote from its seat, a control chamber in which the pressure condition varies in accordance with the connections selectively made by the switching valve, and a bypass channel connected to the pressure chamber and the control chamber, the flow through which is controlled by the pressure in the control chamber and thereby by said switching valve, for selective admission of high pressure fluid to the pressure chamber, whereby a hydraulic closing force can be selectively exerted upon said valve needle in addition to the force exerted by the closing spring.

2. A fuel injection system as defined by claim 1, wherein said nozzle further includes a housing which defines a chamber adjacent the tip of said valve needle and wherein said pump piston is provided with means for controlling the communication between said chamber and said spring chamber containing said valve-closing spring.

3. A fuel injection system as defined by claim 2, further including means for controlling the pressure in said spring chamber in dependence on engine variables, for example rpm and load.

4. A fuel injection system as defined by claim 1, wherein said bypass channel includes pressure control means.

5. A fuel injection system as defined by claim 4, wherein said pressure control means is a throttle valve.

6. A fuel injection system as defined by claim 5, wherein said pressure control means controls the return flow of fluid from said pressure chamber and includes a check valve which opens in the direction of said pressure chamber.

7. A fuel injection system as defined by claim 5, wherein said pressure control means controls the flow of fluid to said pressure chamber and further including a return valve opening the communication between said pressure chamber and a region upstream of said bypass channel.

8. A fuel injection system as defined by claim 5, wherein said pressure control means includes means for adjustment on the basis of engine variables, for example rpm and load.

9. A fuel injection system as defined by claim 4, wherein said pressure contol means is a pressure control valve.

10. A fuel injection system as defined in claim 1, wherein said pressure chamber is the spring chamber containing said valve-closing spring.

11. In a high pressure fuel injection system which includes a hydraulically driven piston-type pump and nozzle assembly for each cylinder, each assembly further including a servo pressure chamber, a servo piston in said pressure chamber, said servo piston having a diameter larger than the diameter of the pump piston of said piston-type pump for actuating said pump piston and further including a switching valve for selectively connecting the servo pressure chamber with a source of high pressure fluid and with a return line, said nozzle further including a valve-closing needle and a valve-closing spring contained in a spring chamber, the improvement comprising:

a nozzle housing within which the spring chamber is defined, a pressure chamber also defined by the nozzle housing, an intermediate piston, axially and sealingly movable in said housing, and extending with one end face into said pressure chamber and with the other end face into said spring chamber, a control chamber between the switching valve and the servo pressure chamber in which the pressure condition varies in accordance with the connection selectively made by the switching valve, and a bypass channel connected to the pressure chamber and the control chamber, the flow through which is controlled by the pressure in the control chamber and thereby by said switching valve, for selective admission of high pressure fluid to the pressure chamber, whereby a hydraulic closing force can be selectively exerted upon said valve needle in addition to the force exerted by the closing spring.

12. A fuel injection system as defined by claim 11, further comprising a return spring for moving said intermediate piston away from said valve needle thereby defining an initial clearance between said intermediate piston and said valve needle and wherein said return line is connected to said pressure chamber.

13. A fuel injection system as defined by claim 12, in which said return spring is said valve-closing spring.

14. A fuel injection system as defined by claim 12, in which said initial clearance between said valve-closing needle and said intermediate piston is equal in magnitude to the axial stroke of said valve needle in the operation of said nozzle.

* * * * *